US006938616B2

(12) United States Patent
Walk

(10) Patent No.: US 6,938,616 B2
(45) Date of Patent: Sep. 6, 2005

(54) ARCHERY BOW ACCESSORY MOUNTING SYSTEM AND METHOD

(75) Inventor: Randy J. Walk, Erda, UT (US)

(73) Assignee: Jas. D. Easton, Inc., Van Nuys, CA (US)

( * ) Notice: Subject to any disclaimer, the term of this patent is extended or adjusted under 35 U.S.C. 154(b) by 0 days.

(21) Appl. No.: 10/681,001

(22) Filed: Oct. 8, 2003

(65) Prior Publication Data

US 2005/0076895 A1 Apr. 14, 2005

(51) Int. Cl.[7] ..... F41B 5/00
(52) U.S. Cl. ..... 124/86; 124/44.5
(58) Field of Search ..... 248/220.1, 235; 124/23.1, 44.5, 86, 87, 88, 89

(56) References Cited

U.S. PATENT DOCUMENTS 1,292,984 A * 2/1919 Allen ..... 211/34
3,916,477 A * 11/1975 Baker, Sr. ..... 16/94 D
5,305,728 A * 4/1994 Young et al. ..... 124/87
5,386,814 A * 2/1995 Denton ..... 124/44.5
5,394,859 A * 3/1995 Janeway ..... 124/87
5,428,901 A * 7/1995 Slates ..... 33/265
5,577,695 A * 11/1996 Ruckwardt ..... 248/200
6,612,299 B2 * 9/2003 Martin et al. ..... 124/86

OTHER PUBLICATIONS

Photograph of Kodiak rest attachment, 2003 Kodiak Outdoors Product Guide.
Photograph of Kodiak sight mount, 2003 Kodiak Outdoors Product Guide.
Photograph of PSE mount, 2004 PSE Product Guide.
Photograph of Martin mounting, 2003 Martin Product Guide.

* cited by examiner

*Primary Examiner*—John A. Ricci
(74) *Attorney, Agent, or Firm*—Holland & Hart

(57) ABSTRACT

A method and apparatus for mounting accessories onto a bow. Accessories are mounted onto a bow in a precise, repeatable manner so that an archer need only to position and calibrate or adjust a particular accessory for a particular bow once. Therefore, when the calibrated accessory is removed from the bow it can later be reattached to the archery bow in the precise previous location thereby eliminating the need for the archer to recalibrate the accessory. Likewise, the present invention requires only one mounting hole in the handle riser to minimize the negative structural ramifications of drilling multiple holes.

49 Claims, 4 Drawing Sheets

300
301
330
315
116
114
336
305
334
332
105
128
112
110
100
118
338
310
337
119
117
115

330 / 332
301
128
300
112
320
116
315
114
105
336
305
117
115
338

301
112
300
116
105
320
114
305
115
338

ARCHERY BOW ACCESSORY MOUNTING SYSTEM AND METHOD

TECHNICAL FIELD

This invention relates to archery bows and accessories, and more particularly to a method and apparatus for mounting accessories to archery bows.

BACKGROUND OF THE INVENTION

For centuries, archery bows and arrows have been used for hunting and competition. More recently, substantial advancements in archery bow technology have resulted in greatly improved accuracy and range.

Today's archery bows fall within two primary categories: so-called traditional archery bows (i.e., long bows and recurves) and compound archery bows. Modern archery bows are made of a variety of materials, including wood, metal, and complex composite materials, such as fiberglass and polyethylene. Modern archery bows are also made in various shapes, contours, and configurations. A typical compound archery bow includes a handle riser section and a pair of limbs attached to opposite ends of the riser section. A wheel or pulley is typically mounted to the distal end of each limb. A bowstring and cable system interconnects the pulleys or wheels (and thus the distal ends of the limbs) to generate limb flexion as the bow is drawn. Upon release of the bowstring, energy stored in the limbs is transmitted to the arrow to launch the arrow toward the intended target.

With the advent and modernization of compound archery bows, an incredible explosion of archery accessories for compound archery bows has followed. Typically, archery bow accessories are mounted to the handle riser section of an archery bow. Such archery bow accessories include, without limitation, an arrow rest, a sight, a stabilizer, a cable guard, and an arrow quiver.

A common problem relating to archery bow accessories is that it is often difficult to store the archery bow in a case, for example, with all the accessories attached to the archery bow. For example, typical archery bow stabilizers extend well beyond the front edge of the handle riser portion of the archery bow. Quivers and archery sights can extend both forwardly and laterally relative to the handle riser section of an archery bow. Thus, it is often desirable, and sometimes required, to remove from archery bow these accessories prior to storing a bow within an archery bow storage case. The problem with removing archery bow accessories, however, is the difficulty in securing the accessory in the same, repeatable position relative to the handle riser section.

Furthermore, modern bows are precision instruments. The forces that influence arrow trajectory must all be fully balanced to allow for consistency in the force exerted on the arrow by the bowstring when released. Therefore, the location of all accessories and adjustments made to the accessories must be done in a precise repeatable manner so as to avoid detuning the entire bow.

A common obstacle in designing accessories for bows is the necessity to mount the archery bow accessory in a precise, repeatable position. Often, a dove-tail mount is used to secure archery accessories to an archery bow. Such dove-tail mounts do not lend themselves well to precise, repeatable positioning of the accessory. Therefore, there is a need in the archery bow industry for a method and apparatus designed to allow archery accessories to be mounted on an archery bow in a precise, repeatable manner.

SUMMARY OF EMBODIMENTS OF THE INVENTION

The foregoing and other problems are solved by the present invention, which relates to a method and apparatus for mounting accessories to an archery bow. Accessories are mounted to an archery bow in a precisely repeatable manner so that the accessory can be removed from and reinstalled to the handle riser portion without the need to recalibrate the accessory or the archery bow. Thus an archer need only position and adjust or calibrate a particular accessory for a particular bow once, even if the accessory is later removed from and reinstalled on the archery bow. Therefore, when the adjusted accessory is removed from the bow it can later be reattached in the same location it had been attached previously.

In one of many possible embodiments, the present invention provides an archery accessory mounting assembly, comprising a first sliding mount surface for sliding engagement with a bow, a second abutting mount surface for limiting slide distance of the first sliding mount surface, the second abutting mount surface being in a different plane than the first sliding mount surface, and a third surface opposite the first sliding mount surface having an angled portion for translating a mounting force in a first direction to a sliding force in a second direction. The first and second surfaces may be substantially orthogonal to one another. The angled portion of the third surface may comprise a tapered recess receptive of a mounting screw with a similarly tapered surface such that fastening the mounting screw to the archery bow provides the mounting force in a first direction. In one embodiment, the mounting screw bears against only a leading part of tapered recess. Accordingly, the mounting force in a first direction provided by the mounting screw causes a sliding motion of the first sliding mount surface along the bow lateral to the mounting screw, until the second abutting mount surface engages the bow. According to some embodiments, the tapered recess comprises a tapered portion of varying depth. The tapered recess may also include two overlapping, generally circular recesses. The archery accessory may comprise, without limitation, an arrow rest, an arrow sight, an arrow stabilizer, an arrow quiver, or an arrow level.

According to another embodiment, the present invention provides an archery accessory mounting apparatus, comprising a first mounting surface and a second mounting surface, the first and second mounting surfaces being in different planes, and a first recess opposite of the first mounting surface, the recess comprising a taper of varying depth. The taper of varying depth is receptive of a fastener that includes a shallow tapered portion such that when the fastener is inserted into the recess, the fastener bears against the shallow tapered portion. The apparatus may be coupled to a bow, and the bow may therefore include a bow recess receptive of the fastener, where the first recess and the bow recess comprise offset centerlines. As the fastener is secured within the bow recess, the offset centerlines move closer to one another. The sliding movement between the bow and the archery accessory mounting apparatus is limited, however, by the second surface bearing against a bow surface as the fastener is threaded into the bow recess. According to some embodiments the different planes are substantially orthogonal to one another.

According to another embodiment, the present invention provides an archery accessory mounting device, comprising an archery accessory having a first mounting surface and a second mounting surface, the second mounting surface being substantially orthogonal to the first mounting surface, and a tapered recess opposite of the first mounting surface, the tapered recess defining an first outer edge having a first center, and a second inner edge having a second center, where the first and second centers are not coincident. According to this embodiment the tapered recess may be tapered to varying depths, and the tapered recess may be tapered at approximately within a range of 20°–75°. The tapered recess may include a first tapered surface portion and a second tapered surface portion such that the first tapered surface portion has a smaller surface area than the second tapered surface portion, per radial degree. The surface area per radial degree of the tapered recess may be continuously variable.

According to another embodiment, the present invention provides an archery accessory mounting apparatus comprising a bow having a first recess, the first recess having a first center line, an accessory mount having a second recess, the second recess having a second center line, a fastener extending through the first and second recesses and attaching the accessory mount to the bow, where the first and second center lines are not coincident. The fastener may comprise a third centerline coincident with the first center line.

Another aspect of the present invention comprises a method for securing an accessory to a bow comprising positioning an accessory adjacent to a bow, inserting a fastener through a tapered recess of the accessory and into a recess in the bow, engaging a surface of the fastener with a surface of the tapered recess, applying an orthogonal aligning force to the accessory by engaging of the surface of the fastener with the surface of the tapered recess, thereby positioning the accessory in a precise repeatable position on the bow. The positioning of the accessory adjacent to a bow may further include approximately aligning the tapered recess on the accessory with the mounting recess on the bow. The inserting of the fastener through the tapered recess of the accessory and into a recess on the bow may include aligning the fastener with a centerline of the recess in the bow, but not aligning the fastener with a centerline of the tapered recess of the accessory. According to this method the accessory may comprise a first mounting surface, a second mounting surface substantially orthogonal to the first mounting surface, and a third surface opposite of the first mounting surface, where engaging a surface of the fastener with a surface of the tapered recess further comprises screwing the fastener into the recess in the bow so as to produce a mounting force normal to the third surface of the accessory. The mounting force normal to the third surface is at least partially transduced by the fastener and the tapered recess into the orthogonal aligning force, the aligning force moving the second surface into engagement with a mating bow surface at a precise, repeatable position.

The present invention contains numerous advantages over the prior art. Prior techniques for securing accessories onto a riser require estimating the location of the accessory relative to the riser when securing the two components together, or reliance solely upon machine screws, which usually have sufficient "play" or looseness such that repeatable positioning during the attachment process is unpredictable at best and impossible at worst. The present invention requires a single mounting hole in the riser, and allows an accessory to be repeatably screwed onto a riser in a precise repeatable position that allows an archer to remove and reattach the accessory into the same position.

The foregoing, together with other features and advantages of the present invention, will become more apparent when referred to the following specification, claims and accompanying drawings.

BRIEF DESCRIPTION OF THE DRAWINGS

The accompanying drawings illustrate various preferred embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION OF THE INVENTION

The present invention is directed to a method and apparatus for mounting accessories onto a bow. According to principles described herein, accessories are mounted onto an archery bow in a precise, repeatable manner so that an archer need only position and calibrate a particular accessory for a particular bow once. Therefore, when the calibrated accessory is removed from the archery bow it can later be reattached to the archery bow in the precise previous location thereby eliminating the need for the archer to adjust or recalibrate the accessory. Likewise, the present invention requires only one mounting hole in the handle riser, which minimizes the negative structural ramifications of drilling numerous holes. In addition, while embodiments of the present invention are described in the context of a method and apparatus for mounting an arrow rest accessory onto a bow, those skilled in the art will recognize that the teachings of the present invention are applicable to other applications and not limited to the particular embodiments shown.

As used throughout the specification and claims, the term "mount surface" is used broadly to mean any surface that has or will have a direct or indirect interface with an intended device. For example, a "mount surface" includes accessory surfaces that interface with a bow. In addition, the term "approximately" is used to indicate values within 10% of a given value. The words "including" and "having," shall have the same meaning as the word "comprising."

Figure 1:
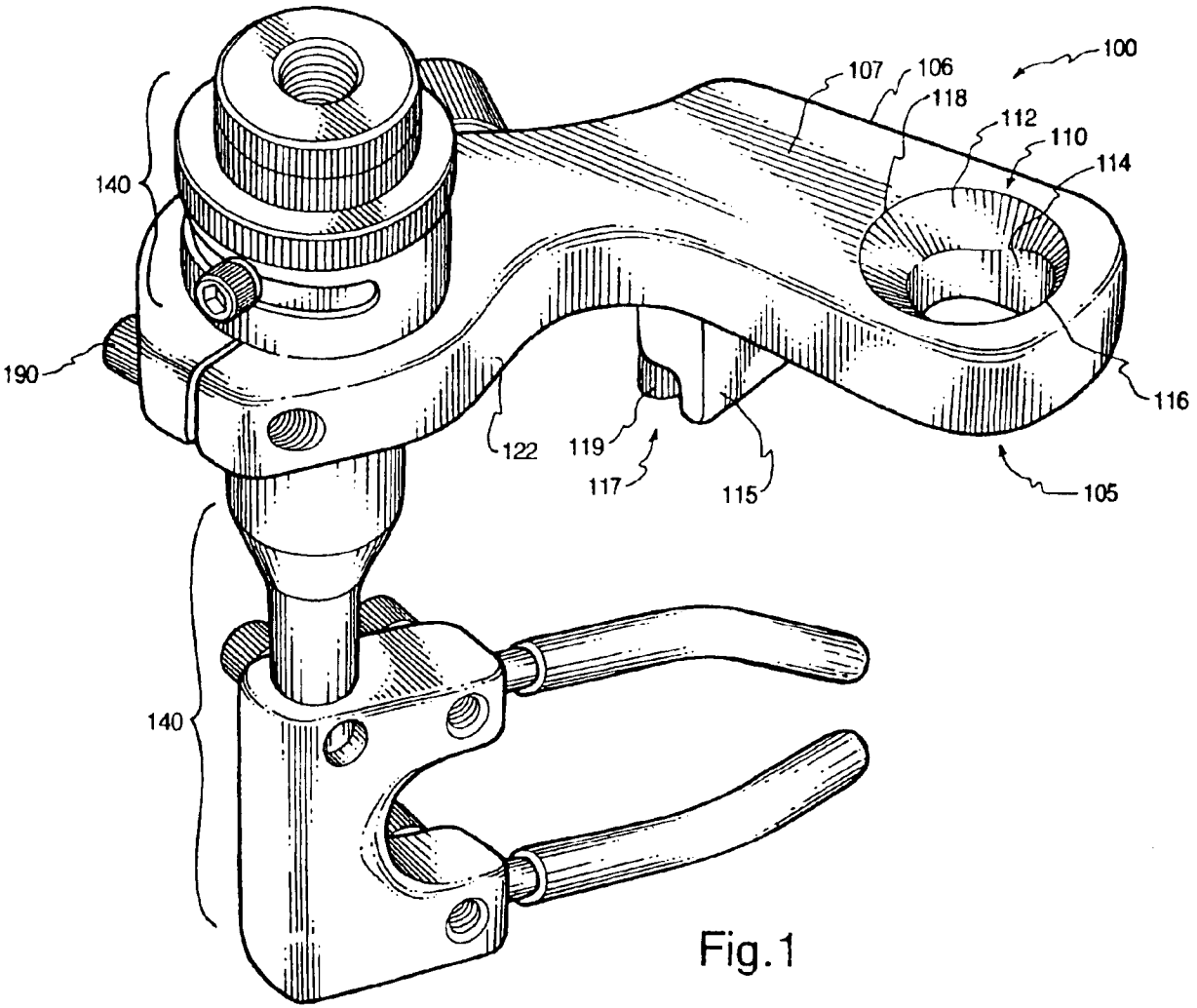
FIG. 1 is a perspective view of an archery accessory mounting assembly incorporating an arrow rest accessory according to one embodiment of the present invention.

Turning now to the figures, and in particular to FIG. 1, an archery accessory mounting assembly 100 is shown according to one embodiment of the present invention. The archery accessory mounting assembly 100 includes a first mounting plate or bracket 106 and a second mounting plate or bracket 117. The first and second mounting plates 106, 117 may be made of a rigid structural material, such as carbon steel.

The first mounting plate or bracket 106 comprises a first sliding mount surface 105, and the second mounting plate 117 includes a second abutting mount surface 115. The first sliding mount surface 105 and the second abutting mount surface 115 are arranged in different planes from one another. According to FIG. 1, the first sliding mount surface 105 and the second abutting mount surface 115 are approximately orthogonal to each other.

As shown in FIG. 1, the first sliding mount surface 105 is a generally flat surface and provides for sliding engagement with a handle riser 305 (FIG. 3) of an archery bow as discussed below. The first sliding mounting plate 106 also includes a third surface 107 opposite of the first sliding mount surface 105. According to the embodiment of FIG. 1, the third surface 107 is substantially parallel to the first sliding mount surface 105, but this is not necessarily so.

The third surface 107 includes an angled portion for translating a mounting force from a first direction to a second direction as discussed in more detail below. According to FIG. 1, the angled portion of the third surface comprises a tapered recess 110. The tapered recess 110 extends through the first mounting plate 106 and includes a tapered portion 112 and a straight portion 114. The tapered portion 112 may be tapered at one or more angles ranging between approximately 20 and 75 degrees, preferably about 45 degrees.

The tapered portion 112 of the recess 110 is advantageously formed to facilitate the translation of a mounting force in a first direction to an aligning force in a second direction, while also allowing sliding movement of the archery accessory mounting assembly 100 as it is being installed. Therefore, according to FIG. 1, the tapered portion 112 of the recess is of varying depth. The tapered portion 112 includes a shallow or leading part 116 and a deep or trailing part 118. As used herein, "leading" and "trailing" indicate that as the archery accessory mounting assembly 100 is installed, it tends to move in a direction from the trailing to the leading portions. According to FIG. 1, the tapered portion 112 is generally circular, and the shallow or leading part 116 comprises no more than half (180 degrees or less) of the tapered portion 112. According to some embodiments, the shallow or leading part 116 comprises no more than approximately 10% of the tapered portion. However, the shallow portion 116 and the deep portion 118 may not have any clearly defined demarcation therebetween, as the variable depth of the tapered portion 112 may be, and preferably is, continuously variable.

Figure 2:
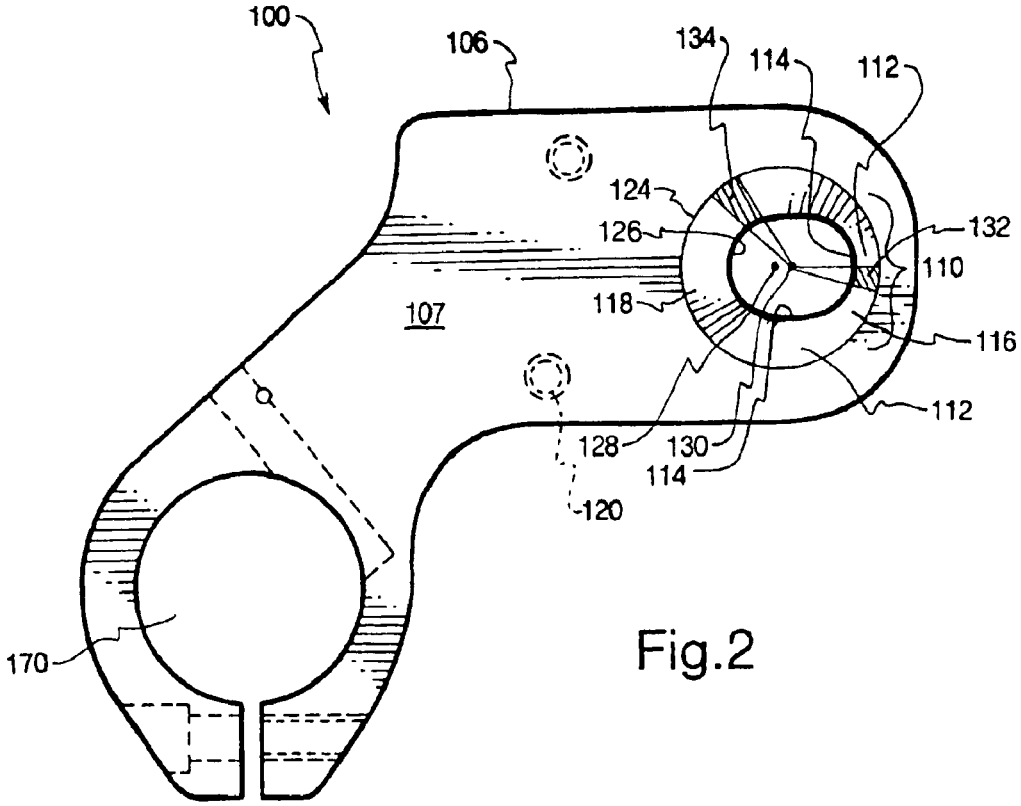
FIG. 2 is a top view of the archery accessory mounting assembly of FIG. 1 without the arrow rest accessory according to one embodiment of the present invention.

The variation in depth of the tapered portion 112 results in a number of features. Referring to FIG. 2, the tapered portion 112 defines a first outer edge 124 and a second inner edge 126. The first outer edge 124 is at a transition between the tapered portion 112 and the third surface 107. The second inner edge 126 is at a transition between the tapered portion 112 and the straight portion 114. The first outer edge 124 has a first center 128 and the second inner edge 126 has a second center 130. However, because the tapered portion 112 of the recess 110 is of varying depth, the first and second centers 128, 130 are not coincident according to FIG. 2. The first and second centers 128, 130 are offset or spaced from one another according to the embodiment shown. Offsetting the first and second centers 128, 130 facilitates movement of the first sliding mount surface 105 when the archery accessory mounting assembly 100 is attached to a bow as described in more detail below.

In addition to the offset centers 128, 130, the variation in depth of the tapered portion according to FIG. 2 creates a tapered portion 112 surface area that varies per radial degree. That is, if a radial section of one degree (measured, for example, from second center 130, but not shown to scale) has a first surface area 132, a second different radial section of one degree may have a second surface area 134. According to some embodiments, the surface area of the tapered portion 112 is continuously variable. The tapered recess 110 is receptive of a fastener, for example the screw 300 is shown and described in more detail below with reference to FIGS. 3A–3C.

As mentioned above with reference to FIG. 1, the second abutting mount surface 115 is arranged substantially orthogonal to the first sliding mount surface 105. To facilitate attachment between the first plate 106 and the second plate 117, the first plate 106 may include one or more threaded recesses 120 receptive of fasteners, such as the screw 119 shown in FIG. 1. The screw 119 thus extends through the second plate and threads into the recesses 120. According to the embodiment of FIGS. 1–2, two screws 119 extend into threaded recesses 120 through the second plate 117 although only one of them can be seen in FIG. 1. A second screw can be seen, however, in the embodiment shown and described below with reference to FIG. 5. The first plate 106 may include multiple threaded recesses 120, such as the four shown in FIG. 2, so that the second plate 117 can attach to the first plate 106 in multiple positions. Alternatively, the first and second plates 106, 117 comprises a single integral piece.

According to the embodiment of FIGS. 1–2, the first mounting plate 106 also includes an angled leg or extension 122 to which an accessory may be mounted. The angled leg 122 may extend at an angle between approximately 20° and 75° from horizontal, preferably approximately 45° from horizontal. The accessory shown in FIG. 1 is an arrow rest 140. However, as used herein the term "accessory" is not limited to the arrow rest 140 shown, but may comprise any archery accessory including, but not limited to: a sight, a stabilizer, a quiver, a cable guard, or a level, any of which may also be mounted to the first mounting plate 106. In addition, the accessory and the first mounting plate 106 need not be separate, the accessory may be integrally formed with the archery accessory mounting assembly 100.

The arrow rest 140 illustrated in FIG. 1 extends through a generally circular adjustable aperture 170 shown in FIG. 2. The arrow rest 140 may be mounted within the aperture 170 by adjusting a fastener, which, according to the present embodiment is a screw 190. Adjustment of the screw 190 either opens or closes the aperture 170 in order to stabilize the arrow rest 140 within, or release the arrow rest 140 from, the aperture 170. The arrow rest 140 or other archery accessory may be of any type or shape, and is not limited to the particular embodiment shown in FIG. 1.

Figures 3A, 3B, 3C:
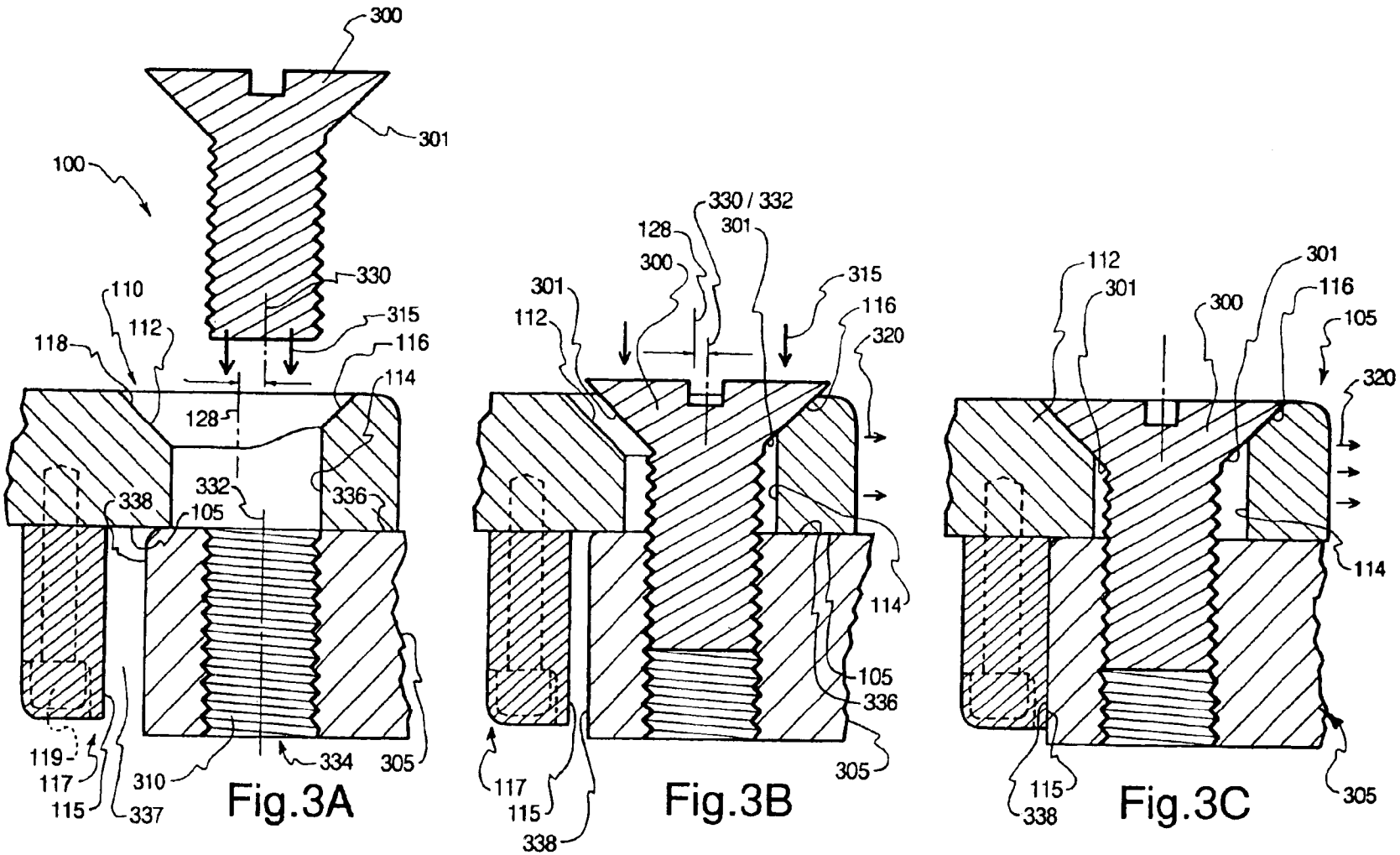
FIG. 3A is a partial sectional view of the archery accessory mounting assembly of FIG. 2 in relation to a bow, but prior to insertion of a fastener, according to one embodiment of the present invention.
FIG. 3B is a partial sectional view of the archery accessory mounting assembly of FIG. 3A as the fastener is being inserted through the assembly and into the bow according to one embodiment of the present invention.
FIG. 3C is a partial sectional view of the archery accessory mounting assembly of FIG. 3B with the fastener fully inserted into the bow according to one embodiment of the present invention.

The first sliding mount surface 105 and the second abutting surface 115 facilitate mounting arrow accessories such as the arrow rest 140 onto a bow in a precise location so that such accessories need only be calibrated a single time. Referring next to FIGS. 3A–3C, attachment of the archery accessory mounting assembly 100 to a bow 305 is shown. FIGS. 3A–3C illustrate in cross-section the handle riser 305 of the archery bow, the archery accessory mounting assembly 100, and a fastener. The fastener of FIGS. 3A–3C is a screw 300 and has a taper 301 shaped to substantially mate with the tapered portion 112 of the tapered recess 110.

As shown in FIG. 3A, when the archery accessory mounting assembly 100 is placed adjacent to the bow 305 for mounting thereto, the first sliding mount surface 105 rests against a first bow surface 336. However, there may be a gap 337 between the second abutting mount surface 115 and a second bow surface 338. In addition, a centerline 330 of the screw 300 is generally coincident with a centerline 332 of a threaded bow recess 334 in order for the screw 300 to be properly inserted into the threaded bow recess 334. However, the centerline 330 of the screw 300 is not necessarily coincident with the first center 128 of the tapered recess 110. Accordingly, as the screw 300 is inserted through archery accessory mounting assembly 100 and into the threaded handle riser recess 334, a mounting force in a first direction 315 is applied to the tapered portion 112. However, because the tapered portion 112 is tapered to different depths, initially only the shallow or leading part 116 of the taper is in contact with the screw taper 301 as shown in FIG. 3B. Therefore, as the screw taper 301 bears against the leading part 116 of the tapered recess 110, the mounting force in the first direction 315 is at least partially translated into a lateral sliding or aligning force in a second direction 320. According to FIGS. 3A–3C, the second direction is lateral to and substantially orthogonal with the screw 300. The sliding force in the second direction 320 initiates sliding movement of the first sliding mount surface 105 across the first handle riser surface 336. The movement of the first sliding mount surface 105 causes the second abutting surface 115 to move toward the second handle riser surface 338. The insertion of the screw 300 may continue to cause the first sliding mount surface 105 to move across the first handle riser surface 336 until the second abutting mount surface 115 bears against the second handle riser surface 338. When the second abutting surface 115 bears against the second handle riser surface 338, the archery accessory mounting assembly is in a precise, repeatable position. According to the embodiment of FIGS. 3A–3C, the deep part 118 of the tapered portion 112 does not directly interface with the screw taper 301, even when the second abutting surface 115 is bearing against the handle riser 305, such that the second abutting surface 336 remains interfaced with the second handle riser surface 338. Therefore, according to the embodiment of FIGS. 3A–3C, the second abutting surface 117, not the tapered portion 112, limits slide movement of the archery accessory mounting assembly. However, according to some embodiments, the deep part 118 of the tapered portion 112 may be designed to bear against the screw taper 301 when the second abutting surface 115 bears against the second handle riser surface 338.

Figure 4:
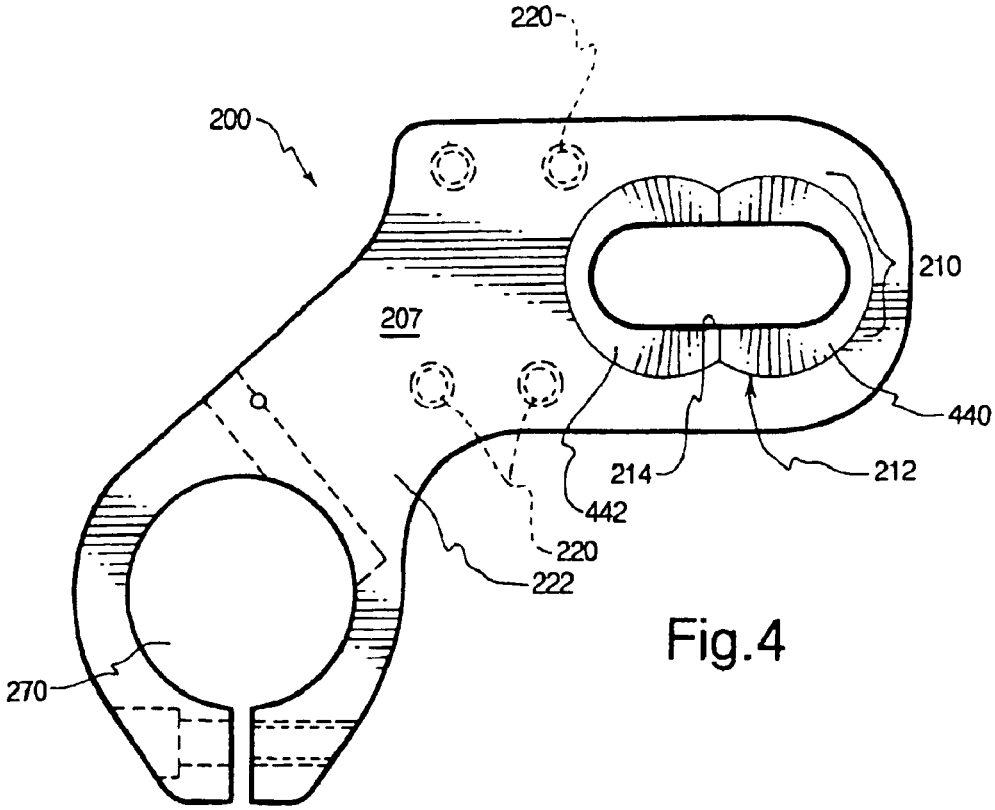
FIG. 4 is a top view of an archery accessory mounting assembly according to another embodiment of the present invention.
Figure 5:
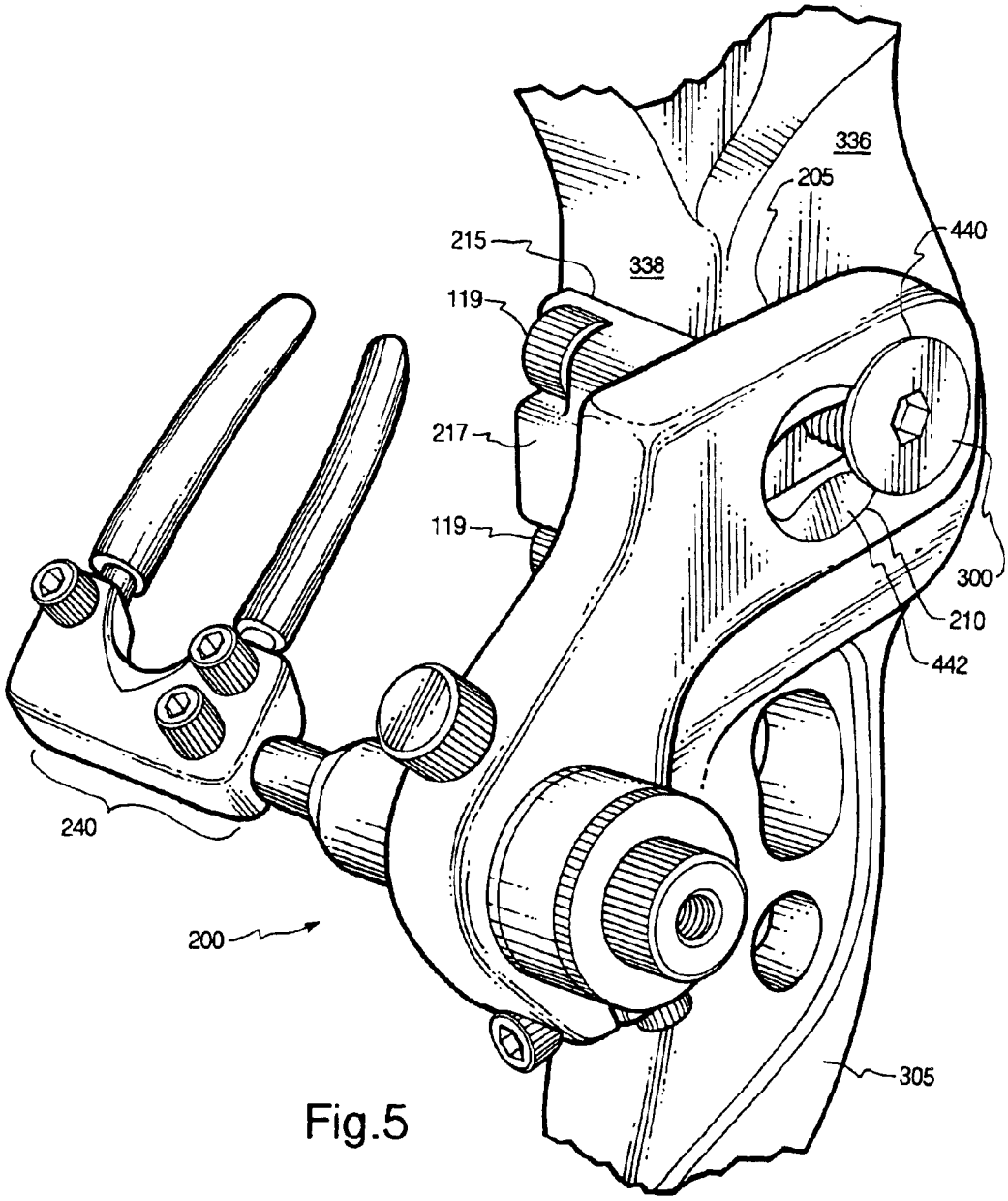
FIG. 5 is a perspective view of the archery accessory mounting assembly of FIG. 4 attached to a bow and incorporating an archery accessory according to one embodiment of the present invention.

Referring next to FIGS. 4–5, an alternative embodiment of an archery accessory mounting assembly 200 according the present invention is shown. According to the embodiment of FIGS. 4–5, a first sliding mount surface 205 is configured to interface with a second abutting mount surface 215 and an arrow rest 240 in the same manner as shown in FIGS. 1–2. Likewise, the archery accessory mounting assembly 200 includes four mounting holes 220 and an adjustable aperture 270. However, a tapered recess 210 of the alternative embodiment is different from the tapered recess 110 of FIGS. 1–2. The tapered recess 210 comprises a first tapered circle 440 that is similar or identical to the tapered recess 110 of FIGS. 1–2, and a second or auxiliary tapered circular portion 442 that is similar or identical to the tapered recess of 110 of FIGS. 1–2, but reversed and overlapping with the first tapered circular portion 440. The result of the overlapping tapered circular portions 440, 442 is a tapered portion 212, and a straight portion 214 with a generally circulinear or ovalinear shape. The tapered recess 210 is thus shaped to accept a fastener device in two separate, but overlapping locations. The two overlapping tapered circular portions 440, 442 are each shaped so as to position the archery accessory mounting assembly 200 in one of two particular locations following receipt of a fastener. In the embodiment of FIGS. 4–5, the various mounting holes 220 allow the bracket 217 (FIG. 5) to be mounted to the handle riser at different locations. Therefore, when a fastener is inserted into the tapered recess 210, the entire first sliding mount surface 205 can be directed into two different precise, repeatable positions with respect to the handle riser of the bow 305. The different mounting holes 220 also add to the flexibility of the device. This allows an archer to easily switch to an accessory that requires a different mounting location (e.g., an overdraw arrow rest versus a standard arrow rest). This multiple location feature may be useful, for example, to move an arrow rest 240 between two different repeatable locations when switching arrow types or bow types. An archer could therefore move the arrow rest 240 from a first precise location to a second precise location and back to the first location without having to recalibrate the arrow rest. It is to be understood that mounting plate 217 could be secured to the angled leg or extension 222 by a slotted fastening system (e.g., a dovetail-type arrangement) such that the plate 217 could be infinitely adjustable between two extreme positions. Such an infinitely adjustable mounting plate 217 would allow the device to be mounted on archery bows of different sizes, types, and styles.

FIG. 5 shows the alternative archery accessory mounting assembly 200 attached to the bow 305 in the first of at least two precise locations. With the archery accessory mounting assembly 200 installed on the handle riser 305 of the bow, the first surface 205 bears against the first handle riser surface 336, and the second abutting mount surface 215 is abutted against the second handle riser surface 338. Again, the alternative archery accessory mounting assembly 200 may be moved to a second position by removing the screw 300 from the first circular portion 440 and moving it to the second circular portion 442. The mounting plate 217 must also be repositioned to the second set of apertures 220. Those skilled in the art will understand that additional taper shapes may be used and that the present invention is not limited to one or two positions. There may be any number of tapered recesses that may or may not have overlapping configurations. The alternative archery accessory mounting assembly 200 may include any number of tapers to facilitate any number of precise mounting positions.

The present invention may be embodied in other specific forms without departing from its spirit or essential characteristics. For example, the teachings of the present invention could be applied to mounting different accessories onto a bow. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An archery accessory mounting assembly, comprising:

a first sliding mount surface for sliding engagement with a bow;

a second abutting mount surface for limiting slide distance of the first sliding mount surface, the second abutting mount surface being in a different plane than the first sliding mount surface;

a third surface opposite the first sliding mount surface having an angled portion for translating a mounting force in a first direction to a sliding force in a second direction.

2. An archery accessory mounting assembly according to claim 1 wherein the first and second surfaces are substantially orthogonal to one another.

3. An archery accessory mounting assembly according to claim 2 wherein the first and second surfaces comprise first and second plates removably attachable to one another in at least two positions.

4. An archery accessory mounting assembly according to claim 1 wherein the angled portion of the third surface comprises a tapered recess receptive of a mounting screw.

5. An archery accessory mounting assembly according to claim 4 wherein insertion of the mounting screw provides the mounting force in a first direction, and wherein the mounting screw bears against only a leading part of tapered recess.

6. An archery accessory mounting assembly according to claim 5 wherein the leading part comprises no more than half of the tapered recess.

7. An archery accessory mounting assembly according to claim 5 wherein the mounting force in a first direction provided by the mounting screw causes sliding motion of the first sliding mount surface along the bow lateral to the mounting screw.

8. An archery accessory mounting assembly according to claim 7 wherein the lateral sliding motion moves the second abutting mount surface toward and into engagement with the bow.

9. An archery accessory mounting assembly according to claim 4 wherein the tapered recess comprises a tapered portion of varying depth.

10. An archery accessory mounting assembly according to claim 9 wherein the tapered recess comprises two overlapping, generally circular recesses.

11. An archery accessory mounting assembly according to claim 1, wherein the mounting assembly further comprises an adjustable cavity receptive of an arrow rest.

12. An archery accessory mounting apparatus, comprising:

a first mounting surface and a second mounting surface, the first and second mounting surfaces being in different planes;

a first recess opposite of the first mounting surface, the recess comprising a taper of varying depth.

13. An archery accessory mounting apparatus according to claim 12 wherein the taper of varying depth is receptive of a fastener, and wherein the taper of varying depth comprises a shallow tapered portion such that when the fastener is inserted into the recess, the fastener bears first against the shallow tapered portion.

14. An archery accessory mounting apparatus according to claim 13, further comprising a bow coupled to the archery accessory mounting device, the bow comprising a bow recess receptive of the fastener, wherein the first recess and the bow recess comprise offset centerlines.

15. An archery accessory mounting apparatus according to claim 14 wherein the offset centerlines move closer to one another as the fastener is threaded into the bow recess.

16. An archery accessory mounting apparatus according to claim 15 wherein sliding movement between the bow and the archery accessory mounting devices is limited by the second surface bearing against a bow surface as the fastener is threaded into the bow recess.

17. An archery accessory mounting apparatus according to claim 12 wherein the different planes are substantially orthogonal to one another.

18. An archery accessory mounting apparatus according to claim 12, further comprising an angled leg having an adjustable cavity receptive of an archery accessory.

19. An archery accessory mounting apparatus according to claim 18, further comprising an angled leg having an adjustable cavity with an arrow rest secured within the adjustable cavity.

20. An archery accessory mounting apparatus according to claim 12 wherein the first recess is substantially circular.

21. An archery accessory mounting apparatus according to claim 20, further comprising a second substantially circular recess disposed opposite of the first surface having a second taper of varying depth.

22. An archery accessory mounting apparatus according to claim 21 wherein the first and second substantially circular recesses overlap.

23. An archery accessory mounting device, comprising:

an archery accessory having a first mounting surface and a second mounting surface, the second mounting surface being substantially orthogonal to the first mounting surface;

a tapered recess opposite of the first mounting surface, the tapered recess defining a first outer edge having a first center, and a second inner edge having a second center, wherein the first and second centers are not coincident.

24. An archery accessory mounting device according to claim 23 wherein the tapered recess is tapered to varying depths.

25. An archery accessory mounting device according to claim 24 wherein the tapered recess is tapered at approximately 20–75 degrees.

26. An archery accessory mounting device according to claim 25 wherein the tapered recess is tapered at approximately 45 degrees.

27. An archery accessory mounting device according to claim 23 wherein the tapered recess comprises a first tapered surface portion and a second tapered surface portion, the first tapered surface portion having a smaller surface area than the second tapered surface portion per radial degree.

28. An archery accessory mounting device according to claim 27 wherein the first and second surface portions are opposite of one another.

29. An archery accessory mounting device according to claim 23 wherein surface area per radial degree of the tapered recess is continuously variable.

30. An archery accessory mounting device according to claim 23 wherein the tapered recess is receptive of a fastening member.

31. An archery accessory mounting device according to claim 30, further comprising an angled leg having an adjustable cavity.

32. An archery accessory mounting device according to claim 23 wherein the archery accessory further comprises an adjustable cavity with an arrow rest inserted therein.

33. An archery accessory mounting device according to claim 23 wherein the second mounting surface comprises a removable plate.

34. An archery accessory mounting device according to claim 33 wherein the first surface comprises a plurality of holes receptive of fasteners, the plurality of holes enabling attachment of the removable plate to the first surface in at least two positions.

35. An archery accessory mounting device according to claim 23 wherein the tapered recess comprises two overlapping circular shapes, each of the two overlapping circular shapes being receptive of a mounting fastener attaching the mounting device to a bow in different positions.

36. An archery apparatus comprising:

a bow having a first recess, the first recess having a first center line;

an accessory mount having a second recess, the second recess having a second center line;

a fastener extending through the first and second recesses and attaching the accessory mount to the bow;

wherein the first and second center lines are not coincident.

37. An archery apparatus according to claim 36 wherein the fastener comprises a third centerline coincident with the first center line.

38. An archery apparatus according to claim 36 wherein the second recess is tapered to various depths.

39. An archery apparatus according to claim 36 wherein the accessory mount further comprises an archery accessory having an angled leg and an adjustable cavity receptive of an accessory component.

40. An archery apparatus according to claim 39, further comprising an arrow rest secured within the adjustable cavity.

41. An archery accessory mounting device, comprising:

an archery accessory having a first surface, a second surface, and a third surface, the second surface being substantially orthogonal to the first surface and the third surface being opposite of the first surface;

a tapered recess disposed in the third surface shaped such that when a mounting force is applied to the tapered recess and normal to the third surface, at least one orthogonal aligning force is transmitted to the mounting device, thereby positioning the first and second surfaces in a precise repeatable position adjacent to a bow.

42. An archery accessory mounting device of claim 41, further comprising at least one auxiliary tapered recess disposed in the third surface such that when a mounting force is applied to the at least one auxiliary tapered recess and normal to the third surface, at least one orthogonal aligning force is transmitted to the mounting device, thereby positioning the first and second surfaces in a different particular precise repeatable position corresponding to a location of the at least one auxiliary tapered recesses.

43. An archery accessory mounting device according to claim 41 wherein the first and third surfaces are substantially parallel to one another.

44. A method for securing an accessory to a bow, comprising:

positioning an accessory adjacent to a bow;

inserting a fastener through a tapered recess of the accessory and into a recess in the bow;

engaging a surface of the fastener with a surface of the tapered recess;

applying an orthogonal aligning force to the accessory by the engaging of the surface of the fastener with the surface of the tapered recess, thereby positioning the accessory in a precise repeatable position on the bow.

45. A method for securing an accessory to a bow according to claim 44 wherein the positioning an accessory adjacent to a bow further comprises approximately aligning the tapered recess on the accessory with the mounting recess on the bow.

46. A method for securing an accessory to a bow according to claim 44 wherein the inserting a fastener through a tapered recess of the accessory and into a recess on the bow further comprises aligning the fastener with a centerline of the recess in the bow, but not aligning the fastener with a centerline of the tapered recess of the accessory.

47. A method for securing an accessory to a bow according to claim 44 wherein the accessory comprises a first mounting surface, a second mounting surface substantially orthogonal to the first mounting surface, and a third surface opposite of the first mounting surface, and wherein the engaging a surface of the fastener with a surface of the tapered recess further comprises screwing the fastener into the recess in the bow so as to produce a mounting force normal to the third surface of the accessory.

48. A method for securing an accessory to a bow according to claim 47 wherein the mounting force normal to the third surface is at least partially transduced by the fastener and the tapered recess into the orthogonal aligning force, the aligning force moving the second surface into engagement with a mating bow surface at the precise repeatable position.

49. An archery accessory mounting device, comprising:

a first angled mounting bracket;

a second mounting plate extending from the first angled mounting bracket;

a recess disposed in the first angled mounting bracket shaped to translate a mounting force in a first direction to a sliding force in a second direction.

* * * * *